US005918797A

United States Patent [19]

Correll

[11] Patent Number: 5,918,797

[45] **Date of Patent: *Jul. 6, 1999**

[54] BLANK FOR IMPROVED PIZZA BOX

[76] Inventor: John D. Correll, 8459 Holly Dr., Canton, Mich. 48187

[ * ] Notice: This patent is subject to a terminal disclaimer.

[21] Appl. No.: 08/954,445

[22] Filed: Oct. 20, 1997

Related U.S. Application Data

[63] Continuation-in-part of application No. 08/731,586, Oct. 16, 1996, Pat. No. 5,833,130.

[51] Int. Cl.[6] ..... B65D 5/22

[52] U.S. Cl. ..... 229/108; 229/112; 229/178; 229/906

[58] Field of Search ..... 229/108, 109, 229/110, 112, 115, 178, 906

[56] References Cited

U.S. PATENT DOCUMENTS

| | | | |
|---|---|---|---|
| 86,544 | 2/1869 | Howells | 229/112 |
| 1,974,552 | 9/1934 | Wallbank | 229/178 |
| 4,128,167 | 12/1978 | Hogshead, III | 229/178 |
| 4,244,509 | 1/1981 | Dlugopolski | 229/178 |
| 4,262,804 | 4/1981 | Nelson, Jr. | 229/178 |
| 4,329,037 | 5/1982 | Caviness | 229/112 |
| 4,979,667 | 12/1990 | Seaman | 229/114 |
| 4,984,734 | 1/1991 | Zion et al. | 229/109 |
| 5,211,329 | 5/1993 | Patton | 229/110 |
| 5,263,634 | 11/1993 | Korine | 229/109 |
| 5,535,940 | 7/1996 | Olds | 229/178 |
| 5,595,339 | 1/1997 | Correll | 229/109 |

*Primary Examiner*—Gary E. Elkins

[57] ABSTRACT

A pizza box blank having a special double-panel wall structure and a non-centrally-positioned interlock receptor means that allows the inner panel of the double-panel wall structure to be formed into a special shape that, in turn, allows the box blank to be made with less material than would be required if the blank contained a conventional double-panel wall structure and interlock receptor means.

21 Claims, 3 Drawing Sheets

BLANK FOR IMPROVED PIZZA BOX

CROSS-REFERENCES TO RELATED APPLICATIONS

This is a continuation-in-part of application Ser. No. 08/731,586, entitled "Multi-function Pizza Carton," filed on Oct. 16, 1996, now U.S. Pat. No. 5,833,130.

FIELD OF THE INVENTION

This invention relates to box blanks made of foldable material and, in particular, to blanks for non-rectangular food cartons, such as non-rectangular pizza boxes.

DESCRIPTION OF THE PRIOR ART

In the pizza industry, the most common carton is a square box that has a double-panel front wall that encloses an end flap from each of two adjacent side walls, thereby creating connected front corners in the box. This type of corner-creating structure, in which a double-panel wall encloses a flap that's attached to an end of an adjacent wall, is referred to as a "double-panel cornerlock structure." And a box that contains a double-panel cornerlock structure is referred to as a type of "double-panel cornerlock box." Double-panel cornerlock structure has been used for decades in the box industry, and is used in making both rectangular and non-rectangular pizza boxes.

The double-panel wall of a double-panel cornerlock structure includes an outer panel that attaches along its bottom edge to the bottom panel of the box and an inner panel that attaches to a top edge of the outer panel.

For the double-panel wall to maintain an upright position, the inner panel must be held parallel to the outer panel. To accomplish this, the double-panel cornerlock structure includes (a) an interlock portion, often in the form of a tab, that's located along the outer (bottom) edge of the inner panel and (b) an interlock receptor means, often in the form of a slot, that's located in the bottom panel of the box or between the bottom panel and the outer panel. When the blank is formed into a box, the interlock portion engages with the interlock receptor means. This causes the inner panel to be held parallel to the outer panel and, thereby, in upright position.

Some double-panel cornerlock structures utilize only one tab to constitute the interlock portion and one corresponding slot to constitute the interlock receptor means. Other double-panel cornerlock structures utilize two or more tabs to constitute the interlock portion and two or more corresponding slots to constitute the interlock receptor means.

The prior art holds numerous examples of rectangular boxes having double-panel cornerlock structures. However, there are only a few examples of non-rectangular boxes having double-panel cornerlock structures.

In the prior art of non-rectangular boxes, the interlock receptor means for the double-panel cornerlock structure has been positioned equidistant between the ends of the bottom edge of the outer panel. We refer to this structure as "centrally-positioned interlock receptor means."

Examples of non-rectangular boxes having centrally-positioned interlock receptor means include the following prior art: Seaman U.S. Pat. No. 4,979,667 granted Dec. 25, 1990; Zion et al. U.S. Pat. No. 4,984,734 granted Jan. 15, 1991; Patton U.S. Pat. No. 5,211,329 granted May 18, 1993; and Korine U.S. Pat. No. 5,263,634 granted Nov. 23, 1993.

The disposition of the interlock receptor means is important because centrally-positioned interlock receptor means on double-panel cornerlock structures has created a problem for the pizza industry. To understand how that has happened, it's necessary to understand that there has developed a need among pizza companies to differentiate one's packaging from that of one's competitors, while still keeping packaging cost from rising.

One way of differentiating one's package is by having a uniquely-shaped box. However, this is difficult to achieve in a cost-effective manner in certain configurations of double-panel cornerlock boxes having centrally-positioned interlock receptor means. That is because, in the blanks for these boxes the centrally-positioned interlock receptor means necessitates that the inner panel of the double-panel wall of the double-panel cornerlock structure extend outward from an end or a side of the box blank beyond the distance of any of the other panels or walls of the blank. In other words, the centrally-positioned interlock receptor means necessitates that the blank be extra-long or extra-wide.

So there has developed a need for a type of double-panel cornerlock structure or, specifically, a type of interlock receptor means, that allows for the creation of cost-effective, uniquely-shaped pizza cartons that don't require extra-long or extra-wide blanks.

Accordingly, there has remained a problem of how to create a variety of uniquely-shaped, cost-containing double-panel cornerlock pizza cartons, or pizza cartons that use no more material than a conventional square carton. It would be highly desirable to provide a type of double-panel cornerlock structure, or specifically a type of interlock receptor means, that overcomes that problem. The problem has not been solved by the prior art but is solved by my invention.

OBJECT AND ADVANTAGE

Accordingly, the object of my invention is a kind of double-panel wall structure and interlock receptor means that enables a reduction in the amount of material used in making the blank for certain configurations of double-panel cornerlock boxes, in particular non-rectangular pizza boxes.

The advantage of my invention is that it enables pizza companies to have a uniquely-shaped double-panel cornerlock box that uses no more, and possibly less, material than a conventional square double-panel cornerlock box.

Further objects and advantages of the invention will become apparent from consideration of the following detailed description, related drawings, and appended claims.

SUMMARY OF THE INVENTION

My invention is a box blank having a type of double-panel cornerlock structure that has a non-centrally positioned interlock receptor means.

This unique structure allows the inner panel of the double-panel cornerlock structure to be formed into a special shape that, in turn, allows the box blank to be made with less material than would be required if the blank contained a double-panel cornerlock structure with centrally-positioned interlock receptor means.

Throughout the following discussion, specific reference is made to non-rectangular pizza boxes. However, it is noted that the invention can be used in other types of boxes, as well.

A complete understanding of the invention can be obtained from the detailed description that follows.

LIST OF REFERENCE NUMERALS

Figure 1:
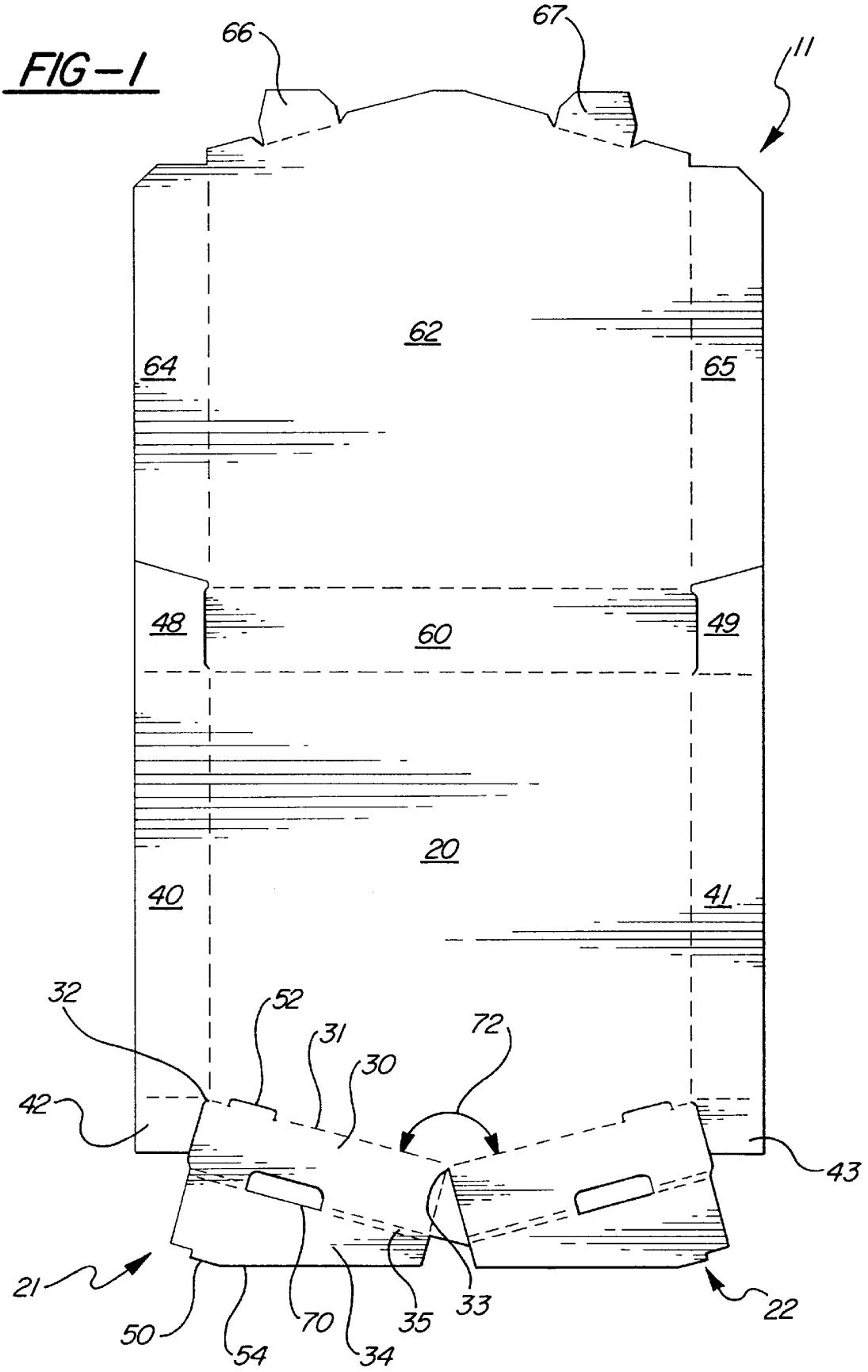
FIG. 1 is a plan view of a blank of the first preferred embodiment of my invention.

Between drawings, like reference numerals designate corresponding parts.

11 blank of first embodiment
12 blank of second embodiment
13 blank of third embodiment
14 blank of fourth embodiment
20 bottom panel
21 first double-panel wall structure
22 second double-panel wall structure
30 first outer panel
31 first outer panel bottom edge
32 first end
33 second end
34 first inner panel
35 top edge (and position of fold lines)
39 corner flap
40 first side wall
41 second side wall
42 front corner flap
43 front corner flap
44 front wall
45 front wall bottom edge
46 corner flap
47 corner flap
48 rear corner flap
49 rear corner flap
50 first interlock portion
52 first interlock receptor means
54 outer (or bottom) edge
60 rear wall
62 cover panel
64 first cover side flap
65 second cover side flap
66 first cover front flap
67 second cover front flap
68 cover front flap
70 cover flap interlock means
72 interior angle greater than 130 degrees
74 oblique angle
76 acute angle

DESCRIPTION OF THE PREFERRED EMBODIMENTS

Figure 2:
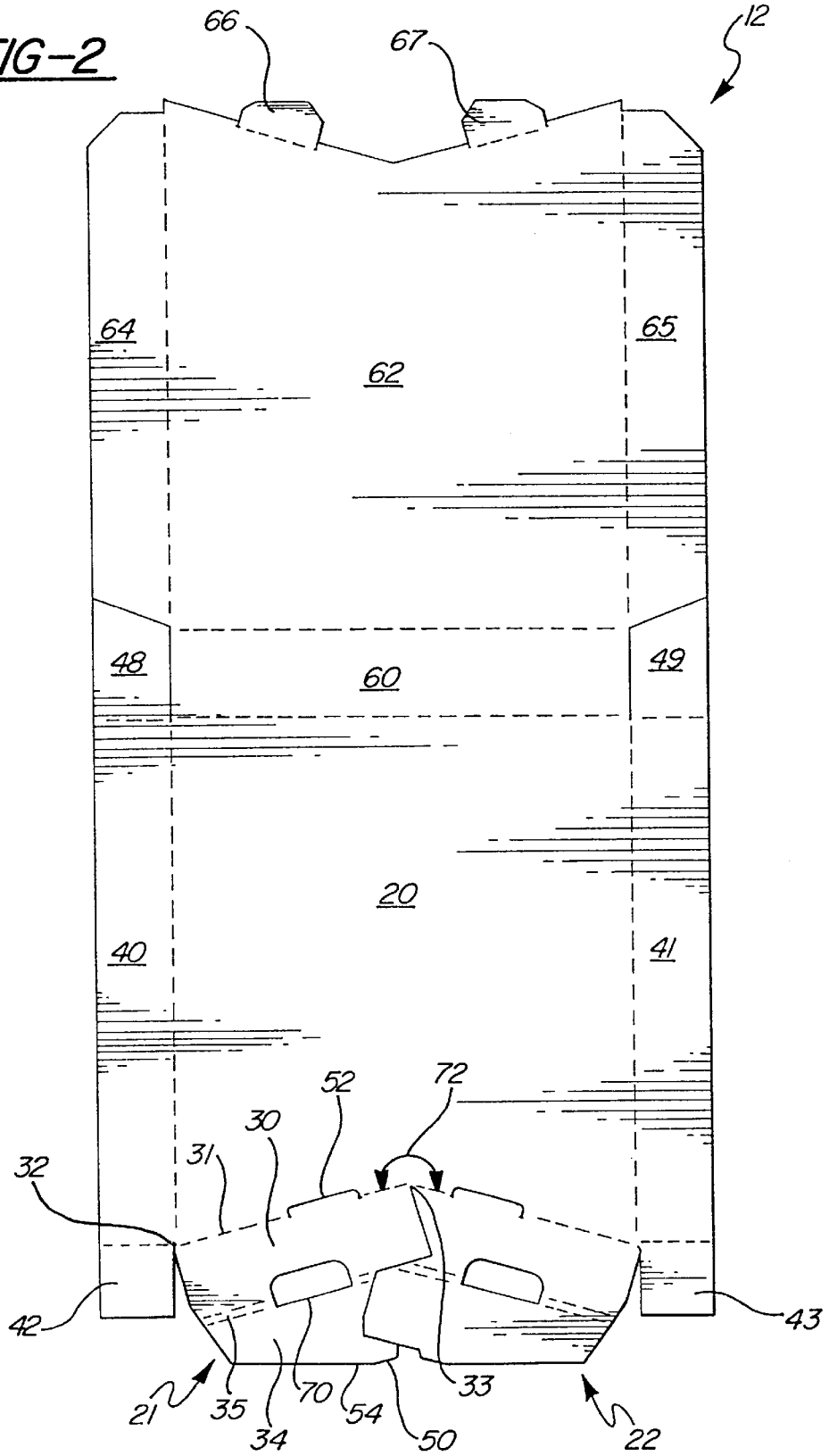
FIG. 2 is a plan view of a blank of the second preferred embodiment of my invention.
Figure 3:
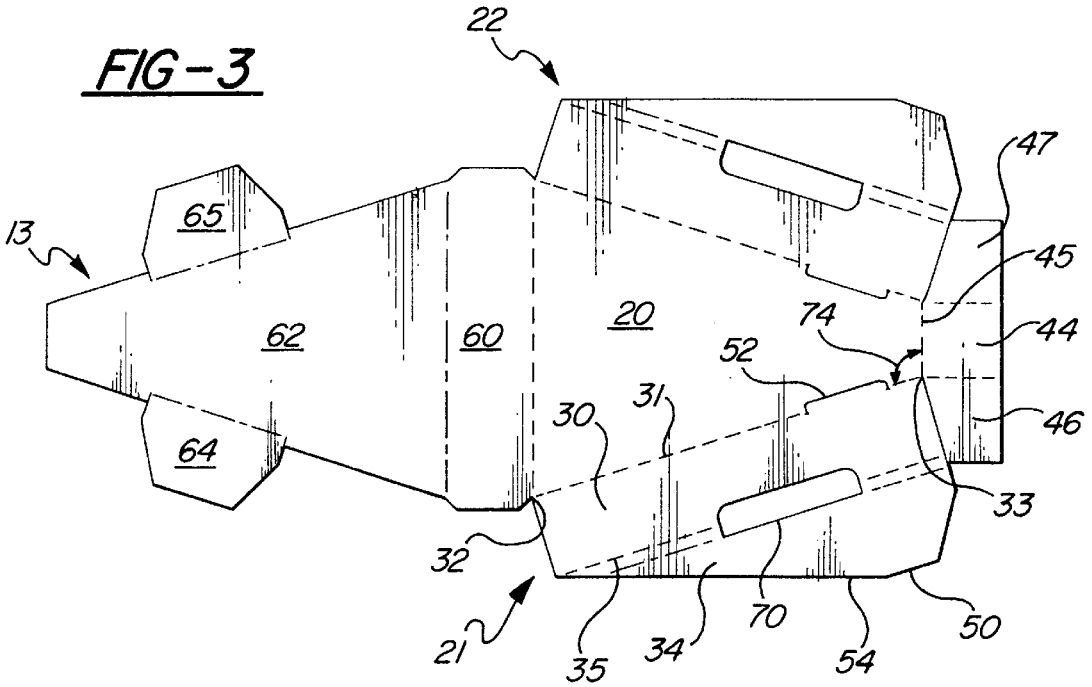
FIG. 3 is a plan view of a blank of the third preferred embodiment of my invention.
Figure 4:
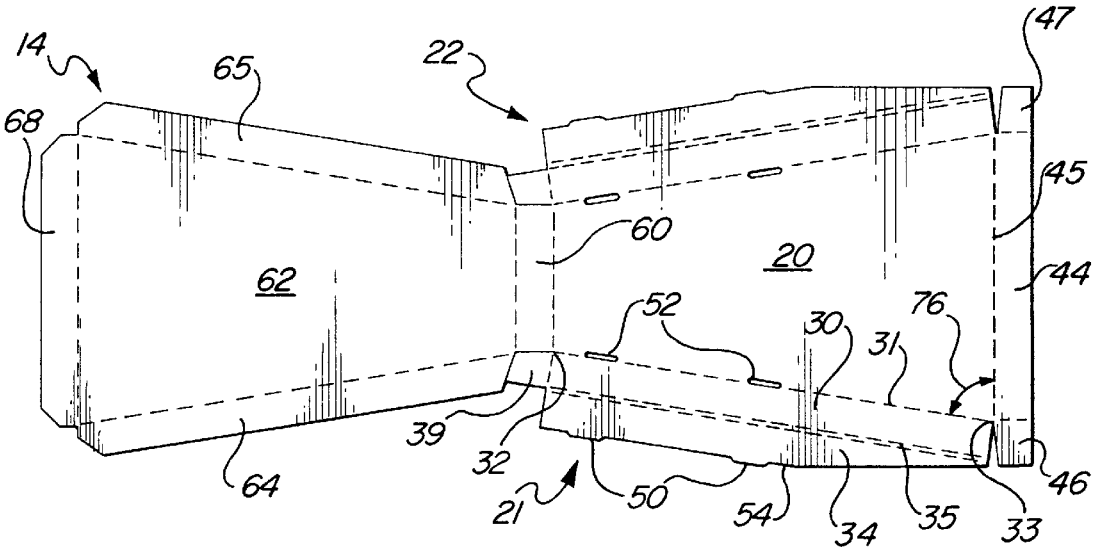
FIG. 4 is a plan view of a blank of the fourth preferred embodiment of my invention.

Referring now to the drawings, there are illustrated four preferred embodiments of the invention in one-piece blanks. The blanks are labeled 11 through 14 and are shown in FIGS. 1 through 4, respectively.

Blanks 11 and 12 each fold into a box that's proportioned to hold a single pizza. Blank 13 folds into a box that's proportioned to hold a pizza slice. Blank 14 folds into a box that's proportioned to hold two pizzas of different size. It will be appreciated, as the description proceeds, that my invention may be realized in different embodiments and that the illustrated embodiments may be formed into different shapes and sizes for different functions.

The following description applies to each of blanks 11 through 14, except where noted otherwise.

Each blank has a bottom panel 20 and first and second double-panel wall structures 21 and 22, respectively, which are attached to panel 20. The following description of structure 21 also applies to structure 22, even though the components of structure 22 are not labeled in the drawings.

Double-panel wall structure 21 comprises a first outer panel 30 that is hingedly attached at a first outer panel bottom edge 31 to bottom panel 20. Bottom edge 31 has first and second ends 32 and 33, respectively. In addition, wall structure 21 has a first inner panel 34 that is hingedly attached to a top edge 35 of panel 30. The joining of panels 34 and 30 is accomplished by two narrowly-spaced parallel fold lines, the position of which is also indicated by numeral 35. Even though two fold lines are used to join the panels, it's possible to accomplish the connection with only one fold line, and such would be construed to be within the scope of the invention.

Blank 14 has a corner flap 39 attached to a rear end of panel 30.

Blanks 11 and 12 have first and second side walls 40 and 41 attached to panel 20 and disposed adjacent double-panel wall structures 21 and 22, respectively. Front corner flaps 42 and 43 are attached to front ends of panels 40 and 41, respectively, and rear corner flaps 48 and 49 are attached to rear ends of panels 40 and 41, respectively.

Blanks 13 and 14 have a front wall 44 attached to panel 20 at a front wall bottom edge 45 and disposed between wall structures 21 and 22. Corner flaps 46 and 47 are attached to opposite ends of panel 44.

When a blank is set up into a box, panels 30 and 34 are disposed substantially parallel to one another and a corner flap (42, 43, 46, or 47) is disposed between them, thereby holding a wall panel (40, 41, or 44) in an upright position. To maintain panel 34 substantially parallel to panel 30, a first interlock portion 50 and a first interlock receptor means 52 are used.

Interlock portion 50 is located along outer (or bottom) edge 54 of inner panel 34. In the embodiments, portion 50 is either a tab-like projection along edge 54 or merely an outermost section of edge 54. In blanks 11, 12, and 13, portion 50 consists of a single tab or outermost section. In blank 14, portion 50 consists of a pair of tabs. Therefore, as can be seen, an interlock portion can comprise a plurality of tabs or outermost sections.

Blanks 11, 12, and 13 show interlock receptor means 52 as a single U-shaped slit located between panel 20 and panel 30. When the blank is folded into a box, the U-shaped slit opens up and, thereby, results in a slot that is positioned between the two panels.

Blank 14 shows interlock receptor means 52 as a pair of elongated holes positioned between panel 20 and panel 30. Therefore, as can be seen, an interlock receptor means can comprise a plurality of slits or holes.

In addition, receptor means 52 can take other forms. For example, it could be a single straight slit in panel 20 and also could be two straight parallel slits in panel 20.

In short, any structure that is located in bottom panel 20 or is located between panel 20 and panel 30, and which results in a structure that engages with an interlock portion 50 when the blank is folded into a box, is considered to be an interlock receptor means.

A unique component of my invention is the location of the interlock receptor means in relation to edge ends 32 and 33. In non-rectangular double-panel cornerlock boxes of the prior art, the interlock receptor means is positioned equidistant between ends 32 and 33. We refer to this as "centrally-positioned interlock receptor means." However, in my invention, interlock receptor means 52 is positioned closer to one of ends 32 and 33 than to the other. We refer to this as "non-centrally-positioned interlock receptor means."

Non-centrally-positioned interlock receptor means leads to an additional unique structure. It allows the interlock portion of a double-panel wall to be positioned off-center, or closer to one end of the inner panel than to the other end. In turn, the off-center interlock portion allows for inner panel 34 to be formed into a special configuration. That configuration can be one or a combination of the following: (a) of substantially irregular or asymmetrical shape or (b) of substantially different shape than that of outer panel 30 or (c) of substantially smaller size than panel 30.

The outcome of the special configuration of panel 34 is that it allows for the creation of blanks for non-rectangular double-panel cornerlock pizza boxes, as well as blanks for other types of boxes, to be made of less material than would be required if the blank had an inner panel 34 of conventional rectangular shape or of similar size or shape as that of the outer panel.

Continuing on, each of blanks 11 through 14 has a rear wall 60 attached to panel 20, a cover panel 62 attached to wall 60, and first and second cover side flaps 64 and 65, respectively, attached to cover panel 62. In addition, blanks 11 and 12 also have first and second cover front flaps 66 and 67, respectively, attached to cover panel 62. Blank 14 has a single cover front flap 68 attached to cover panel 62.

Blanks 11, 12, and 13 have a cover flap interlock means 70 positioned in each of double-panel wall structures 21 and 22. When the blank is folded into a box, the cover flaps engage with interlock means 70 to hold the cover panel closed. In the embodiments, interlock means 70 is a slot, but it could take other forms, as well, and such would be construed to be within the scope of the invention.

Finally, it is noted that, in blanks 11 and 12, the outer panel bottom edge 31 of each of structures 21 and 22 are adjacent one another and are disposed at an interior angle 72 that is greater than 130 degrees. It is also noted that in blank 13 outer panel bottom edge 31 and front wall bottom edge 45 are disposed at an oblique angle 74, and in blank 14 the same edges are disposed at an acute angle 76.

Set-up of the Blanks into Boxes

Pertaining to blanks 11 and 12, to fold each into a box, the following procedure can be used. First, fold wall panels 40 and 41 to upright position and fold corner flaps 42 and 43 inward. Second, fold panel 30 of structure 21 to upright position and then fold panel 34 downward until interlock portion 50 engages interlock receptor means 52. Third, repeat step two for folding structure 22 to upright position. Fourth, fold in rear corner flaps 48 and 49. Fifth, close the cover by pulling cover panel 62 forward and tucking cover side flaps 64 and 65 inside the box and tucking cover front flaps 66 and 67 inside cover flap interlock means 70 on each of structures 21 and 22.

Pertaining to blanks 13 and 14, to fold each into a box, the following procedure can be used. First, fold front wall panel 44 to upright position and fold corner flaps 46 and 47 inward. Second, fold panel 30 of structure 21 to upright position and then fold panel 34 downward until interlock portion 50 engages interlock receptor means 52. Third, repeat step two for folding structure 22 to upright position. On blank 14, fold in corner flap 39 on each of structures 21 and 22. Fourth, close the cover by pulling cover panel 62 forward. On blank 13, tuck cover side flaps 64 and 65 inside cover interlock means 70 on each of structures 21 and 22. On blank 14, tuck cover side flaps 64 and 65 and cover front flap 68 inside of the box.

Fold Lines

Within the context of this invention, a fold line can be created by a number of means such as, for example, by a crease or score in the board, by a series of aligned spaced short slits in the board, and by a combination of aligned spaced short and long slits.

In addition, to create a fold line where one panel is folded 180° to lay parallel on another panel, the fold line may constitute two narrowly-spaced parallel scores or series of aligned slits. In this case, the two narrowly-spaced parallel scores or series of aligned slits constitute a single fold line unless otherwise indicated. In conclusion, as referred to herein, a fold line is any line between two points on the blank or box along which the board is intended to be folded when the blank is being erected into a box. The type of fold lines shown in the drawings are presently preferred but it will be appreciated that other methods known to those skilled in the art may be used.

CONCLUSION, RAMIFICATIONS, AND SCOPE

I have disclosed a kind of double-panel wall structure and interlock receptor means that enables a reduction in the amount of material used in making the blank for certain configurations of double-panel cornerlock boxes, in particular non-rectangular pizza boxes.

The illustrated number, size, shape, type, and placement of components represent the preferred embodiments; however, other combinations and configurations are possible within the scope of the invention.

Throughout the previous discussion, reference has been made to packaging pizza. However, it is noted that my invention can be used for creating packaging for other foods and for other applications, as well.

In conclusion, it is understood that my invention is not to be limited to the disclosed embodiments but, on the contrary, is intended to cover various modifications and equivalent arrangements included within the spirit and scope of the appended claims.

I claim:

1. A blank for a non-rectangular box having an improved non-sloping double-panel wall structure, said blank being cut and scored to define:

(a) a bottom panel;

(b) a first double-panel wall structure comprising:

(i) a first outer panel hingedly attached at a first outer panel bottom edge to said bottom panel and having a predetermined shape, said first outer panel bottom edge having first and second ends, (ii) a first inner panel hingedly linked to a top edge of said first outer panel at a first fold line and having a predetermined shape, (iii) a first interlock portion disposed along an outer edge of said inner panel;

(c) a first interlock receptor means disposed adjacent said first outer panel bottom edge, whereby after said blank has been erected into a carton said first interlock portion engages with said first interlock receptor means, thereby causing said first inner panel to be disposed approximately parallel to said first outer panel and forming a first double-panel wall;

wherein:

said first outer panel bottom edge is disposed at an oblique angle to a bottom edge of at least one adjacent wall panel;

said first interlock receptor means is disposed substantially closer to the first end than to the second end of said first outer panel bottom edge;

the predetermined shape of said first inner panel is substantially different from the predetermined shape of said first outer panel;

said first fold line is parallel to said first outer panel bottom edge, whereby after said blank has been erected into said carton said first double-panel wall is substantially non-sloping, thereby resulting in a non-rectangular box having an improved non-sloping double-panel wall.

2. The blank of claim 1 wherein:

said bottom panel is bilaterally symmetrical and has a pair of opposing edges, said pair of opposing edges being non-parallel, non-perpendicular, and non-aligned one to the other.

3. The blank of claim 2 further comprising:

(a) a rear wall hingedly attached to said bottom panel;

(b) a cover panel hingedly attached to said rear wall;

(c) a second double-panel wall structure comprising:

(i) a second outer panel hingedly attached at a second outer panel bottom edge to said bottom panel and having a predetermined shape, said second outer panel bottom edge having first and second ends, (ii) a second inner panel hingedly linked to a top edge of said second outer panel at a second fold line and having a predetermined shape, (iii) a second interlock portion disposed along an outer edge of said second inner panel;

(d) a second interlock receptor means disposed adjacent said second outer panel bottom edge, whereby after said blank has been erected into said carton said second interlock portion engages with said second interlock receptor means, thereby causing said second inner panel to be disposed approximately parallel to said second outer panel and forming a second double-panel wall;

wherein:

said second interlock receptor means is disposed substantially closer to the first end than to the second end of said second outer panel bottom edge;

the predetermined shape of said second inner panel is substantially different from the predetermined shape of said second outer panel;

said second fold line is parallel to said second outer panel bottom edge, whereby after said blank has been erected into said carton said second double-panel wall is substantially non-sloping, thereby resulting in a box having a pair of improved non-sloping double-panel walls;

said first and second outer panel bottom edges are non-parallel, whereby after said blank has been erected into said carton said pair of improved non-sloping double-panel walls are non-parallel.

4. The blank of claim 3 wherein:

said first and second outer panel bottom edges are adjacent one another and are disposed at an interior angle greater than 130 degrees.

5. The blank of claim 3 further comprising:

first and second side walls hingedly attached to said bottom panel and disposed adjacent said first and second outer panels, respectively;

first and second cover front flaps hingedly attached to said cover panel.

6. The blank of claim 3 further comprising:

first and second cover flap interlock means disposed in said first and second double-panel wall structures, respectively.

7. The blank of claim 3 further comprising:

a front wall hingedly attached to said bottom panel at a front wall bottom edge and disposed adjacent said first and second outer panels.

8. The blank of claim 7 wherein:

each of said first and second outer panel bottom edges is disposed at an oblique angle to said front wall bottom edge.

9. The blank of claim 7 wherein:

each of said first and second outer panel bottom edges is disposed at an acute angle to said front wall bottom edge.

10. The blank of claim 7 further comprising:

first and second cover side flaps hingedly attached to said cover panel.

11. The blank of claim 7 further comprising:

first and second cover flap interlock means disposed in said first and second double-panel wall structures, respectively.

12. A blank for a non-rectangular box having at least five walls, said blank being cut and scored to define:

(a) a bottom panel;

(b) a rear wall hingedly attached to said bottom panel;

(c) a cover panel hingedly attached to said rear wall;

(d) opposing first and second side walls hingedly attached to said bottom panel;

(e) first and second double-panel wall structures adjacent said first and second side walls, respectively, and respectively comprising:

(i) first and second outer panels hingedly attached to said bottom panel at respective first and second outer panel bottom edges and each having a predetermined shape, said first and second outer panel bottom edges each having first and second ends, (ii) first and second inner panels hingedly linked to a top edge of said first and second outer panels at first and second fold lines, respectively, and each having a predetermined shape, (iii) first and second interlock portions respectively disposed along an outer edge of said first and second inner panels;

(f) first and second interlock receptor means respectively disposed adjacent said first and second outer panel bottom edges, whereby after said blank has been erected into a carton said first and second interlock portions respectively engage with said first and second interlock receptor means, thereby holding said first and second inner panels approximately parallel to said first and second outer panels and forming first and second double-panel walls;

wherein said first and second interlock receptor means are disposed substantially closer to the first end than to the second end of said first and second outer panel bottom edges, respectively, and the predetermined shape of said first and second inner panels is substantially different from the predetermined shape of said first and second outer panels, respectively.

13. The blank of claim 12 wherein:

said first and second fold lines are parallel to said first and second outer panel bottom edges, respectively, whereby after said blank has been erected into said carton said first and second double-panel walls are substantially non-sloping.

14. The blank of claim 13 wherein:

said first and second side walls are adjacent said rear wall.

15. The blank of claim 14 further comprising:

first and second cover front flaps hingedly attached to said cover panel.

16. The blank of claim 15 further comprising:

first and second cover flap interlock means disposed in said first and second double-panel wall structures, respectively.

17. A blank for a non-rectangular box having a pair of opposing non-parallel double-panel walls, said blank being cut and scored to define:

(a) a bottom panel;

(b) a rear wall hingedly attached to said bottom panel;

(c) first and second double-panel wall structures respectively comprising:

(i) first and second outer panels hingedly attached to said bottom panel at respective first and second outer panel bottom edges and each having a predetermined shape, said first and second outer panel bottom edges each having first and second ends, (ii) first and second inner panels hingedly linked to a top edge of said first and second outer panels at first and second fold lines, respectively, and each having a predetermined shape, (iii) first and second interlock portions respectively disposed along an outer edge of said first and second inner panels;

(d) first and second interlock receptor means respectively disposed adjacent said first and second outer panel bottom edges, whereby after said blank has been erected into a carton said first and second interlock portions respectively engage with said first and second interlock receptor means, thereby holding said first and second inner panels approximately parallel to said first and second outer panels and forming first and second double-panel walls;

wherein:

said first and second interlock receptor means are disposed substantially closer to the first end than to the second end of said first and second outer panel bottom edges, respectively;

the predetermined shape of the first and second inner panels is substantially different from the predetermined shape of the first and second outer panels, respectively;

said first and second outer panel bottom edges are non-parallel, whereby after said blank has been erected into said carton said first and second double-panel walls are non-parallel;

said first and second double-panel wall structures have respective first and second cover flap interlock means.

18. The blank of claim 17 wherein:

said first and second fold lines are parallel to said first and second outer panel bottom edges, respectively, whereby after said blank has been erected into said carton said first and second double-panel walls are substantially non-sloping.

19. The blank of claim 18 further comprising:

a front wall hingedly attached to said bottom panel at a front wall bottom edge and adjacent said first and second outer panels;

a cover panel hingedly attached to said rear wall;

first and second cover side flaps hingedly attached to said cover panel.

20. The blank of claim 19 wherein:

each of said first and second outer panel bottom edges is disposed at an oblique angle to said front wall bottom edge.

21. The blank of claim 19 wherein:

each of said first and second outer panel bottom edges is disposed at an acute angle to said front wall bottom edge.

* * * * *